United States Patent [19]

Jude

[11] Patent Number: 4,618,443

[45] Date of Patent: Oct. 21, 1986

[54] EASY GRIP EASY SCRUB SOAP BAR-SCRUB BRUSH COMBINATION

[76] Inventor: John L. Jude, 200 Edgewater Dr., Coral Gables, Fla. 33133

[21] Appl. No.: 775,375

[22] Filed: Sep. 12, 1985

[51] Int. Cl.[4] ..... A47K 7/03; C11D 17/04

[52] U.S. Cl. ..... 252/92; 15/105; 15/106; 15/160; 15/176; 252/134; 252/DIG. 16; 401/6; 401/19

[58] Field of Search ..... 15/104.92, 104.93, 104.94, 15/106, 176, 105; 401/6, 19; 252/91, 92, 134, 174, DIG. 16

[56] References Cited

U.S. PATENT DOCUMENTS

| | | | |
|---|---|---|---|
| 816,002 | 3/1906 | Burt | 401/19 |
| 1,117,634 | 11/1914 | Bowes | 401/19 |
| 1,259,245 | 3/1918 | Kessler | 15/176 |
| 1,748,008 | 2/1930 | Barnowitz | 401/19 |
| 2,131,500 | 9/1938 | Curtis | 401/19 |
| 2,283,988 | 5/1942 | Heath | 401/6 |
| 2,288,850 | 7/1942 | Share | 401/19 |
| 2,431,913 | 12/1947 | Bowman | 252/92 |
| 2,441,898 | 5/1948 | Novick | 15/160 |
| 2,669,738 | 2/1954 | Kusznir | 401/19 |
| 2,695,416 | 11/1954 | Raimo | 15/106 |
| 2,760,218 | 8/1956 | Gottfried | 401/19 |
| 2,795,807 | 6/1957 | Salvy | 15/160 |
| 2,979,748 | 4/1961 | Beatty | 401/19 |
| 3,128,487 | 4/1964 | Vallis | 15/176 |
| 3,293,684 | 12/1966 | Tundermann | 252/92 |
| 3,447,181 | 6/1969 | Coker | 252/91 |
| 3,961,392 | 6/1976 | Young | 15/105 |
| 4,050,825 | 9/1977 | Stein | 401/19 |
| 4,062,792 | 12/1977 | McNabb | 252/93 |
| 4,479,277 | 10/1984 | Gilman | 15/111 |

FOREIGN PATENT DOCUMENTS

| | | | |
|---|---|---|---|
| 444378 | 8/1926 | Fed. Rep. of Germany | 401/19 |
| 495501 | 6/1954 | Italy | 401/19 |
| 205854 | 10/1923 | United Kingdom | 401/19 |
| 626811 | 7/1949 | United Kingdom | 401/19 |

*Primary Examiner*—Dennis L. Albrecht

[57] ABSTRACT

This device enables an otherwise slippery bar of soap to be able to be gripped much easier than normally when wet or dry. The bar of soap may also be used to scrub dirt from one's body or from under nails etcetera; and if necessary the brush part may be detached. In any event the soap bar may be utilized in its entirety. The soap bar has an insert providing channels on opposite surfaces of the bar in which a scrub brush is releasably engaged.

17 Claims, 2 Drawing Figures

EASY GRIP EASY SCRUB SOAP BAR-SCRUB BRUSH COMBINATION

This invention relates to a new improved soap bar that utilizes a premolded and formed soap bar insert. It is made of a plastic or nylon internal soap bar insert which is utilized to attach an external high outside surface friction scrub brush to the outside of the soap bar.

DESCRIPTION OF THE INVENTION

Figure 1:
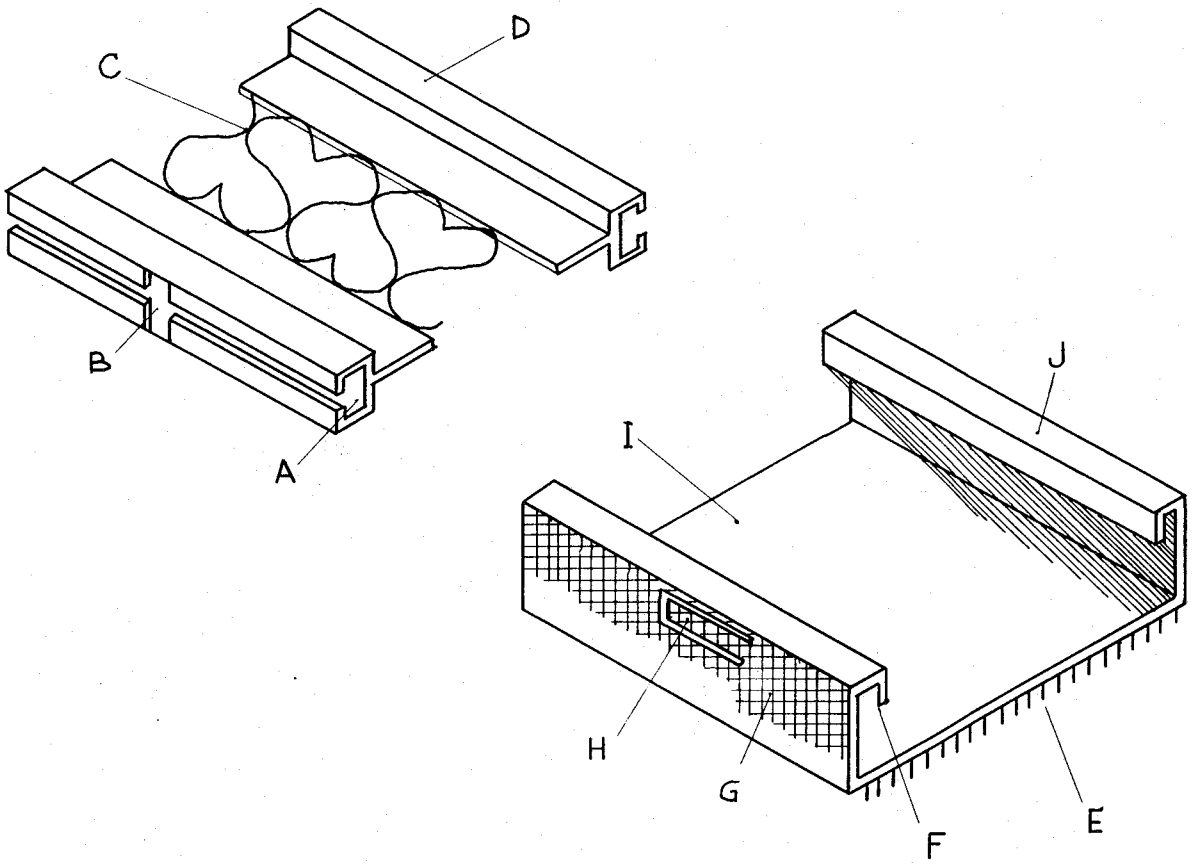
FIG. 1 shows the two labeled separate halves of the interconnecting invention before its subsequent embedding in a bar of soap; this is an isometric view.
Figure 2:
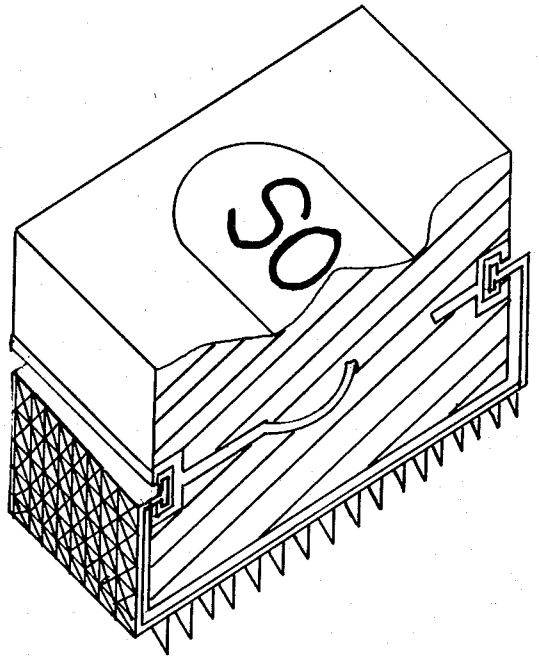
FIG. 2 shows the two halves of the device together; in a transverse cross section, of a bar of soap in an isometric view.

The creation of the "Easy Grip Easy Scrub" soap bar is by molding; by injection molding or cut press forming of a thermosetting material such as polyethylene, nylon or polypropylene or some other plastic, shaped into the two parts shown in FIG. 1. The two parts are labeled with desired molded features of which I will now describe:

In the upper left part of FIG. 1 is the molded plastic soap bar insert; the area labeled A is a slide channel for either a "T" or "L" angled cross section of an interlocking slide as shown by the part labeled F in the lower right of FIG. 1 showing the external "Easy Grip Easy Scrub" soap bar portion.

Continuing in FIG. 1 the part labeled B in the upper left is so designed so the a projecting tooth on the reverse side of the part labeled H located in the lower right of FIG. 1 interlocks with it by means of the inherent spring tension of the plastic material. There may or may not be another such catch fastner used on the corresponding opposite side labeled J in FIG. 1.

The part labeled C in FIG. 1 is of a stringy cross section and forms a interconnecting series of opposing S's so shaped as to be back to back. The part labeled C therefore is used to connect the two halves of the part labeled d together but still allows the soap to form a interconnecting bond around the part labeled C and thus maintain continuity as a bar of soap.

The part labeled "I" shown in the lower right of FIG. 1 serves to bridge the two halves of the parts labeled J together; but also on its lower surface area are brush bristles; labeled E in the lower right portion of FIG. 1, these may be coarse or soft but no longer then an inch in length. The outer sides of the part labeled J are to be covered with a slip resistant surface such as with pyramids or dots that have a high coefficient of surface friction.

This invention of the "Easy Grip Easy Scrub" soap bar is unique I believe because it enables the user to reverse the brush part shown in the lower right of FIG. 1 to the opposite side of the soap bar simply by disengaging the fastner/fastners and sliding the brush part out of its interlocking groove and reinserting it after its inversion. The bar of soap in this way is able to be completely utilized on both sides of the soap bar insert.

I claim:

1. A combination soap bar and scrub brush comprising:

(A) A soap bar having an insert providing channels on opposite surfaces of said bar for releasably engaging a scrubbing implement, said channels being connected to each other by means extending through the center of said bar and (B) A scrubbing implement having means attached thereto for engaging with the channels of the soap bar insert, said scrubbing implement being capable of being removed from the channels and reinserted in inverted position so as to permit utilization of substantially the entire soap bar, said scrubbing implement being releasably engaged with the channels of said insert.

2. A combination soap bar and scrub brush according to claim 1 which has a locking means for holding the scrubbing implement in the channels of the insert.

3. A combination soap bar and scrub brush according to claim 2 wherein the locking means is a spring catch fastener.

4. A combnation soap bar and scrub brush according to claim 1 wherein the channels have a "T" or "L" shaped cross-section.

5. A combination soap bar and scrub brush according to claim 1 wherein the scrubbing implement has at least one slip-resistant surface.

6. A combination soap bar and scrub brush according to claim 5 wherein the slip resistant surface comprises dots or pyramids providing a high coefficient of surface friction.

7. A combination soap bar and scrub brush according to claim 1 wherein the insert and/or scrubbing implement are made from a plastic material.

8. A combination soap bar and scrub brush according to claim 7 wherein the plastic material is a thermosetting plastic.

9. A combination soap bar and scrub brush according to claim 8 wherein the thermosetting plastic is a nylon, polyethylene or polypropylene.

10. A combination soap bar and scrub brush according to claim 6 wherein the plastic parts are made by injection molding.

11. A combination soap bar and scrub brush according to claim 1 wherein the means connecting the channels of the insert are string-like.

12. A combination soap bar and scrub brush according to claim 11 wherein the connecting means comprises an interconnecting series of opposing S's so shaped as to be back to back.

13. A combination soap bar and scrub brush according to claim 1 having bristles no longer than an inch in length.

14. A combination soap bar and scrub brush according to claim 13 wherein the bristles are coarse.

15. A combination soap bar and scrub brush according to claim 13 wherein the bristles are soft.

16. A combination soap bar and scrub brush according to claim 1 wherein the insert has a configuration substantially as shown in FIG. 1.

17. A combination soap bar and scrub brush according to claim 1 wherein the scrubbing implement has a configuration substantially as shown in FIG. 1.

* * * * *